US010027049B2

(12) United States Patent
Chuang et al.

(10) Patent No.: US 10,027,049 B2
(45) Date of Patent: Jul. 17, 2018

(54) ELECTRICAL CONNECTOR AND MANUFACTURING METHOD OF THE SAME

(71) Applicant: FOXCONN INTERCONNECT TECHNOLOGY LIMITED, Grand Cayman (KY)

(72) Inventors: Shun-Jung Chuang, New Taipei (TW); Chiang-Nan Hung, New Taipei (TW); Cheng-Wen Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/663,846

(22) Filed: Jul. 31, 2017

(65) Prior Publication Data

US 2018/0034182 A1 Feb. 1, 2018

(30) Foreign Application Priority Data

Jul. 29, 2016 (TW) ..... 105123979 A

(51) Int. Cl.

| | |
|---|---|
| ***H01R 13/28*** | (2006.01) |
| ***H01R 13/405*** | (2006.01) |
| ***H01R 12/71*** | (2011.01) |
| ***H01R 43/16*** | (2006.01) |
| ***H01R 43/24*** | (2006.01) |
| *H01R 13/22* | (2006.01) |

(52) U.S. Cl.

CPC ..... *H01R 13/405* (2013.01); *H01R 12/716* (2013.01); *H01R 43/16* (2013.01); *H01R 43/24* (2013.01); *H01R 13/22* (2013.01)

(58) Field of Classification Search

CPC ..... H01R 13/22

See application file for complete search history.

(56) References Cited

U.S. PATENT DOCUMENTS

| | | | | |
|---|---|---|---|---|
| 3,193,793 | A * | 7/1965 | Plunkett | H01R 13/33 439/289 |
| 6,038,130 | A * | 3/2000 | Boeck | H01R 9/2675 361/729 |
| 6,162,081 | A * | 12/2000 | Commerci | H01R 13/28 439/287 |
| 6,475,010 | B1 * | 11/2002 | Yu | H01R 4/2433 439/289 |

(Continued)

FOREIGN PATENT DOCUMENTS

| | | |
|---|---|---|
| CN | 102420383 | 4/2012 |
| TW | 201342717 | 10/2013 |

(Continued)

*Primary Examiner* — Tho D Ta

(74) *Attorney, Agent, or Firm* — Wei Te Chung; Ming Chieh Chang

(57) ABSTRACT

An electrical connector includes an insulative housing and a number of contacts received in the insulative housing. The contact includes a first body and a second body extending from the first body. A first protrusion portion is formed by drawing the first body and a second protrusion portion is formed by stamping the second body. The first projecting portion and the second projecting are insert molded in the contact, therefore the contact has a larger intensity.

18 Claims, 12 Drawing Sheets

(56) References Cited

U.S. PATENT DOCUMENTS

| | | | | |
|---|---|---|---|---|
| 8,840,430 | B2 * | 9/2014 | Bausch ..... | H01R 12/714<br>439/587 |
| 9,052,869 | B2 | 6/2015 | Wang et al. | |
| 9,288,925 | B2 | 3/2016 | Fu | |
| 2009/0305568 | A1 | 12/2009 | Ambo et al. | |

FOREIGN PATENT DOCUMENTS

| | | |
|---|---|---|
| TW | M491270 | 12/2014 |
| TW | M505091 | 7/2015 |

* cited by examiner

ELECTRICAL CONNECTOR AND MANUFACTURING METHOD OF THE SAME

BACKGROUND OF THE INVENTION

1. Field of the Invention

The present invention relates to an electrical connector, and particular to an electrical connector with terminals formed by drawing and stamping.

2. Description of Related Art

TW Patent No. M505091 discloses a plug connector includes a lower terminal module, an upper terminal module and an insulative housing. The lower terminal module includes a lower insulator, a plurality of lower terminals and two lower strengthening pieces. The upper terminal module includes an upper insulator, a plurality of upper terminals and two upper strengthening pieces. The upper terminals and the lower terminals are formed by a way of drawing. The lower terminal includes a lower holding plate. A lower contacting portion is formed by drawing the lower holding plate along a top-to-bottom direction. A lower soldering portion extends rearwardly from a rear edge of the lower holding plate. The upper terminal includes an upper holding plate. An upper contacting portion is formed by drawing the upper holding plate along a bottom-to-top direction. An upper soldering portion extends rearwardly from the rear edge of the upper holding plate.

An improved electrical connector is desired.

SUMMARY OF THE INVENTION

Accordingly, the object of the present invention is to provide an electrical connector comprising an insulative housing and a plurality of terminals received in the insulative housing. Each of the terminals has a first body extending along a front-to-back direction and a second body extending forwardly from the first body. The first body has a first projecting portion formed by drawing along a vertical direction perpendicular to the front-to-back direction. The second body has a second projecting portion formed by stamping along the vertical direction. The first projecting portion and the second projecting are insert molded in the terminal, therefore the terminal has a larger intensity.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
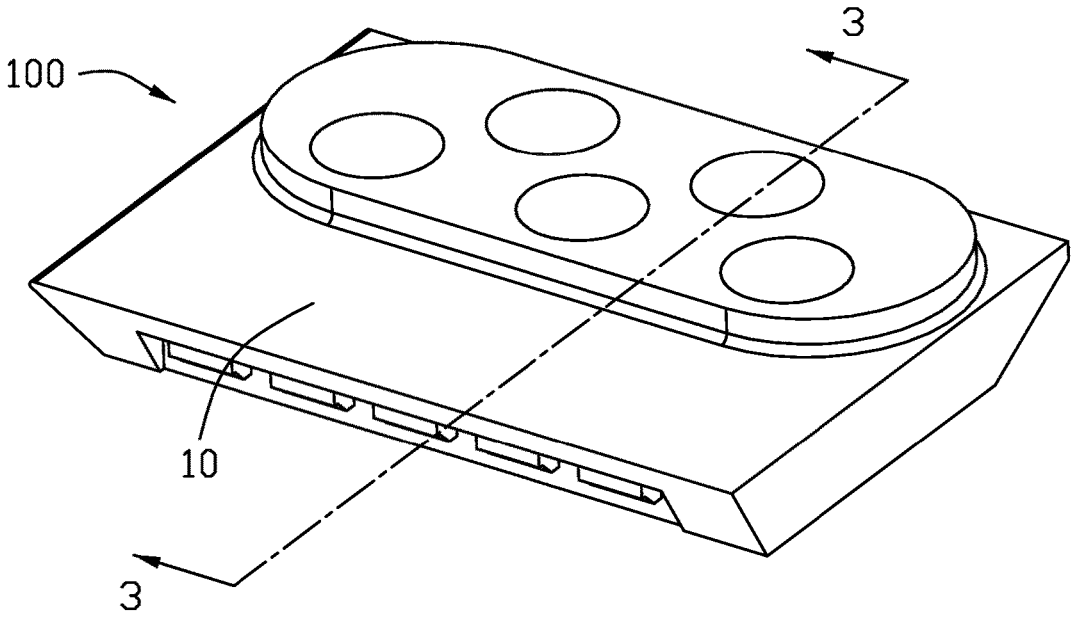
FIG. 1 is a perspective view of an electrical connector in accordance with a first embodiment of the present invention.
Figure 2:
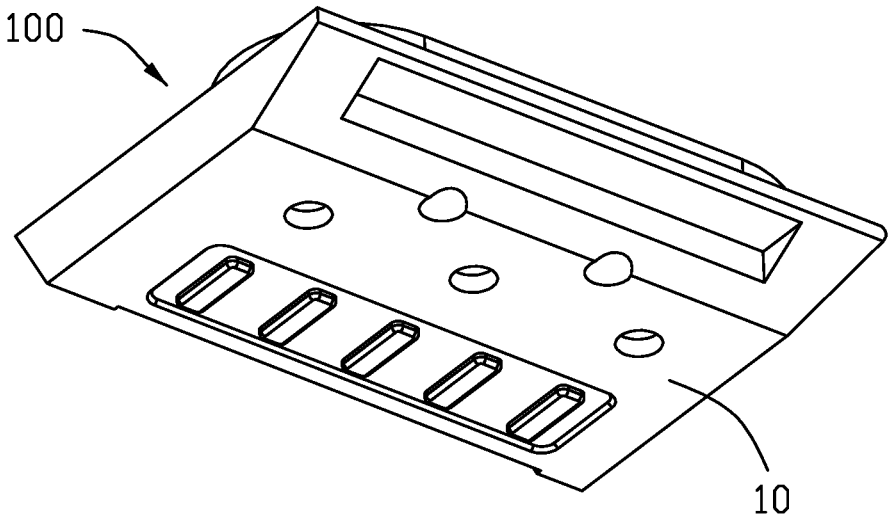
FIG. 2 is another perspective view of the electrical connector in FIG. 1.
Figure 3:
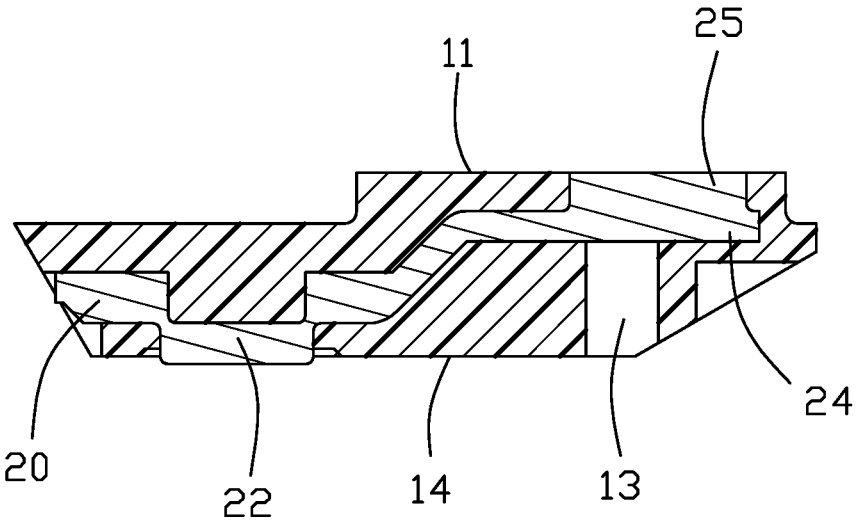
FIG. 3 is a cross-sectional view along line 3-3 shown in FIG. 1.
Figure 4:
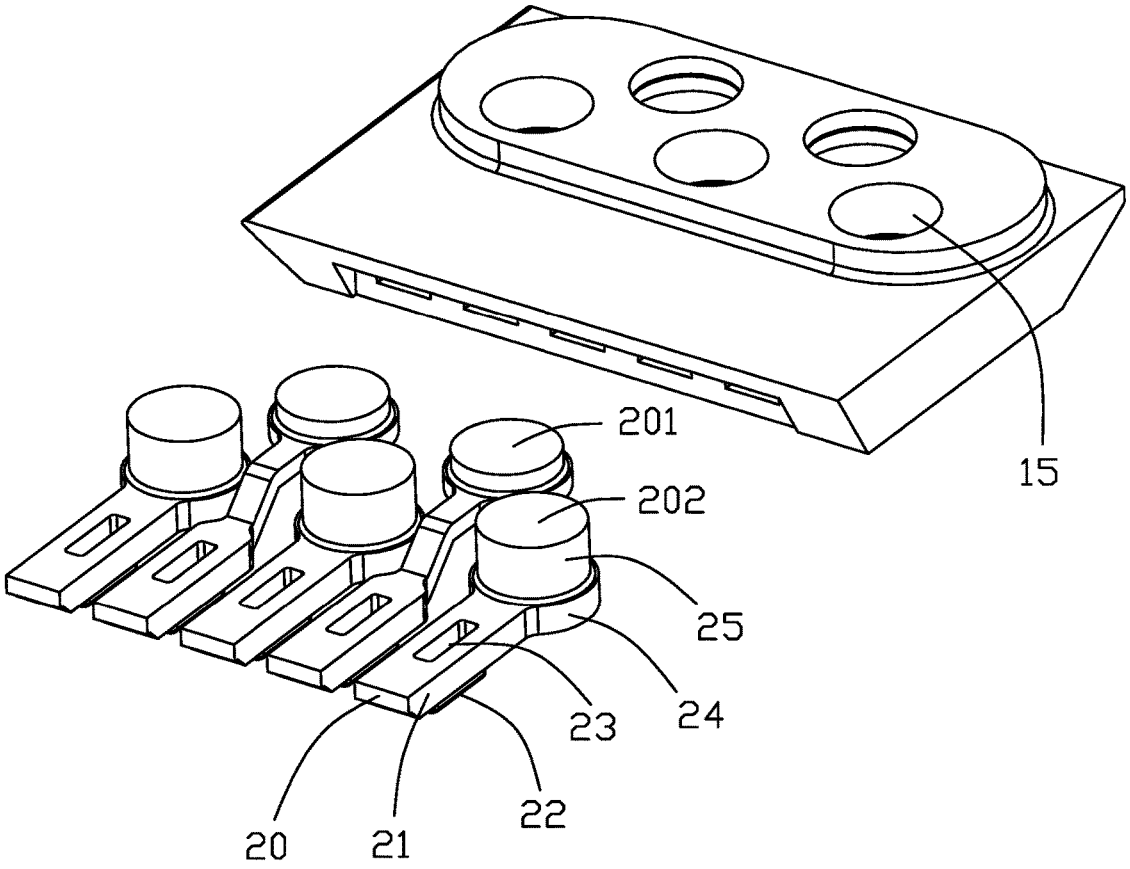
FIG. 4 is an exploded perspective view of the electrical connector in FIG. 1
Figure 4A:
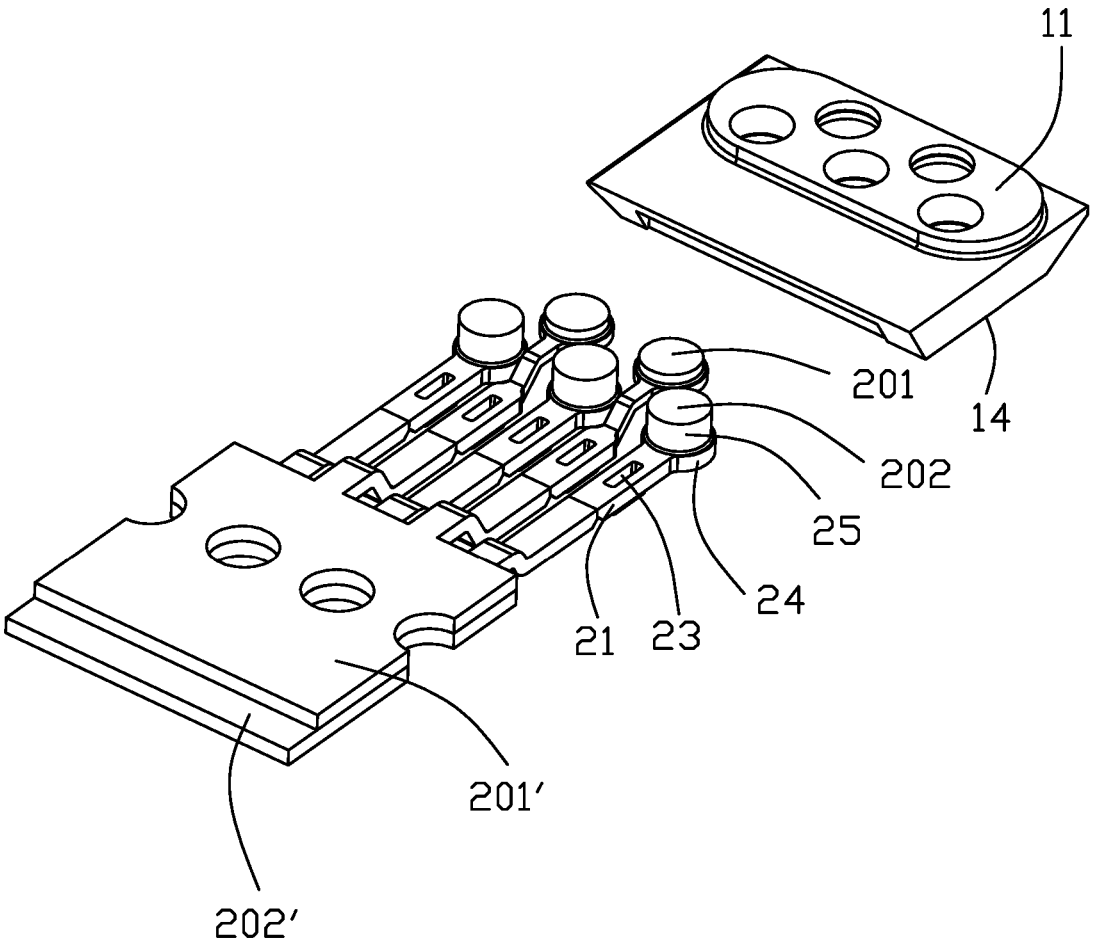
FIG. 4(A) is an exploded perspective view of the electrical connector in FIG. 1 with corresponding contact carriers unremoved therefrom.
Figure 5:
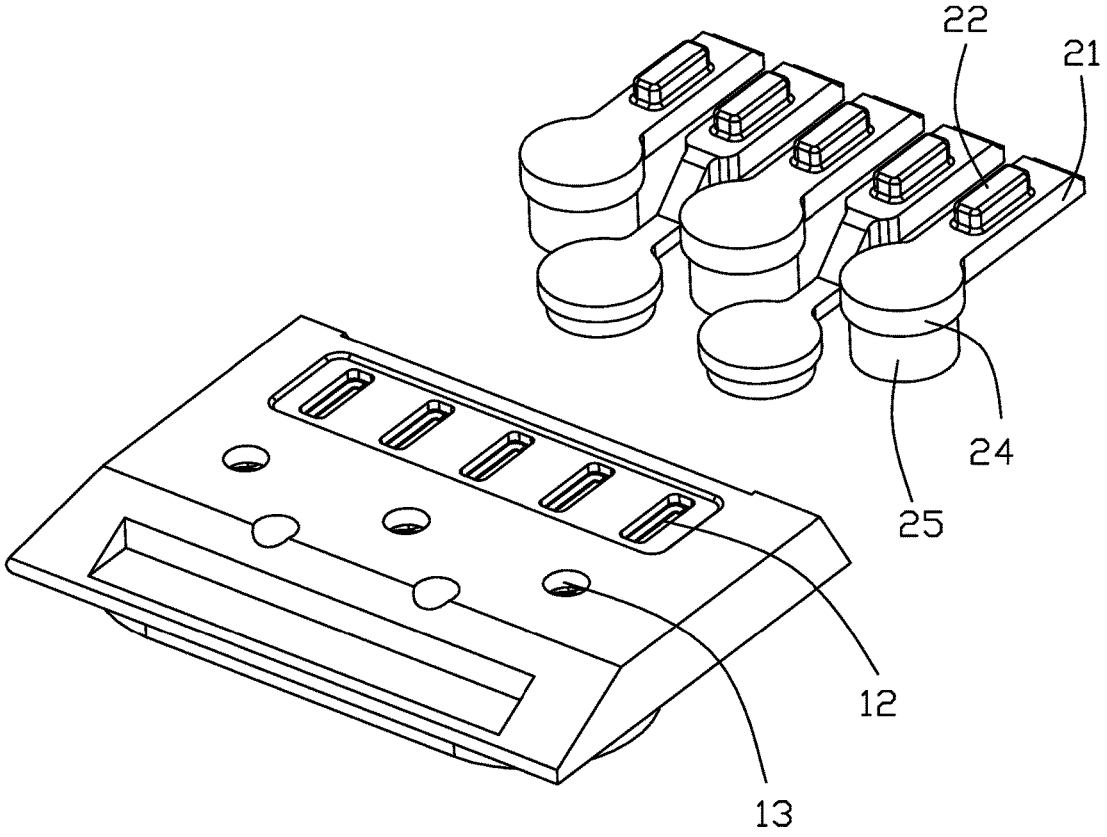
FIG. 5 is another exploded perspective view of the electrical connector in FIG. 4.

Referring to FIGS. 1 to 5, an electrical connector 100 in accordance with a first embodiment of the present invention includes an insulative housing 10 and five terminals 20 insert molded in the insulative housing 10. The insulative housing 10 includes a first contact surface 14 engaging with a printed circuit board and a second contact surface 11 engaging with a mating connector. The first contact surface 14 and the second contact surface 11 face two opposite directions. The insulative housing 10 includes five receiving slots 12 and five through holes 13 recessing upwardly from the first contact surface 14. The insulative housing 10 includes five receiving holes 15 recessing downwardly from the second contact surface 11. The five terminals 20 include two first (group) terminals 201 arranged in a first horizontal row along the transverse direction and three second (group) terminals 202 arranged in a second horizontal row along the transverse direction. Each of the terminals 20 includes a first body 21 extending along a front-to-back direction and a second body 24 extending forwardly from the first body 21 wherein the other side of the first body 21 is adapted to be linked with a removable contact carrier 201'(202') opposite to the second body 24. The first body 21 includes a first face and a second face opposite to the first face. The first body 21 includes a first projecting portion 22 formed by drawing downwardly from the first face. The first body 21 defines a first slot 23 recessing downwardly from the second face and opposite to the first projecting portion 22. The first projecting portion 22 is received in the receiving slot 12 and extends downwardly beyond the first contact surface 14 of the insulative housing 10. The second body 24 includes a second projecting portion 25 formed by stamping/forging the second body 24 along a vertical direction. The second projecting portion 25 is received in the receiving hole 15. The top surface of the second projecting portion 25 is aligned with the second contact surface 11 of the insulative housing 10. The second projecting portion 25 of the second terminal 202 is thicker than the second projecting portion 25 of the first terminal 201. It is noted that in this embodiment even though the first bodies 21 of both the first terminals 201 and the second terminals 202 are located at the same level, because the second projecting portions 25 of the first terminals 201 are of a depth different from that of the second terminals 202, the first terminals 201 are linked with the first contact carrier 201' while the second terminals 202 are linked with the second contact carrier 202' for consideration of the manufacturability thereof wherein the first contact carrier 201' is stacked upon the second contact carrier 202' before removal. In this embodiment, the receiving slots 12 are provided for receiving the corresponding first projecting portions 22 while the through holes 13 are provided for receiving a core pin of the mold to supportably position the corresponding second projecting portions 25 in position during insert-molding the terminals 20 within the insulative housing 10.

Figure 6:
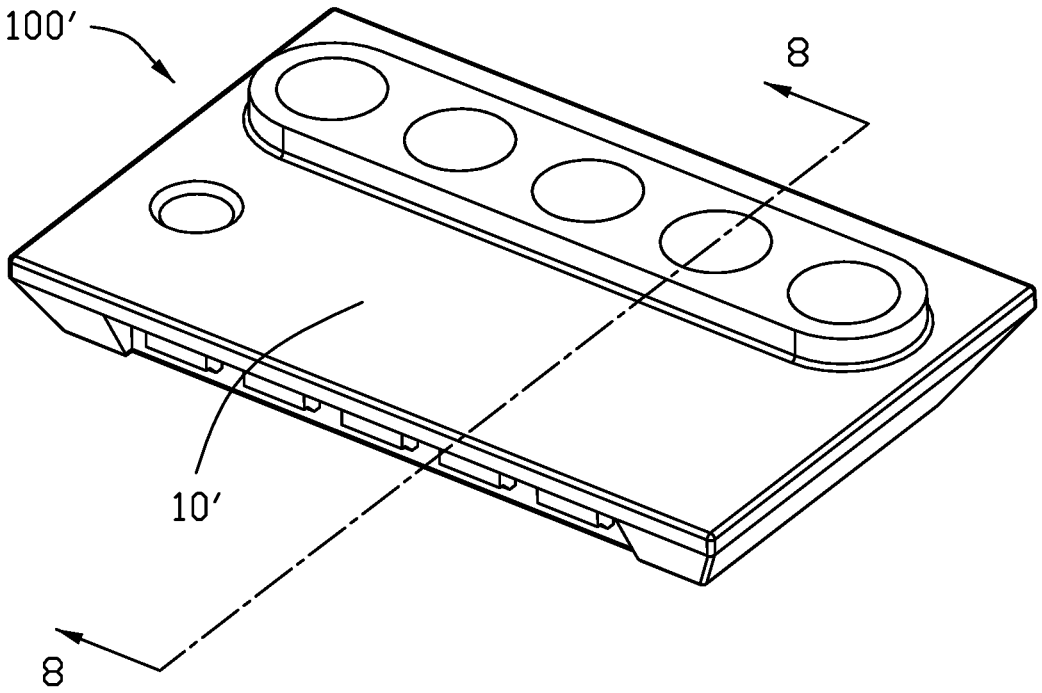
FIG. 6 is a perspective view of an electrical connector in accordance with a second embodiment of the present invention.
Figure 7:
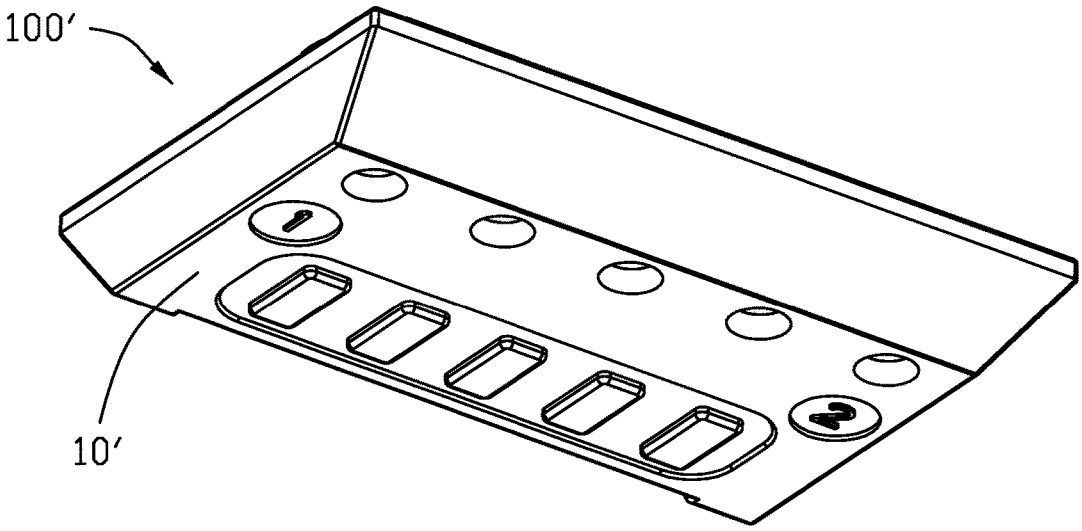
FIG. 7 is another perspective view of the electrical connector in FIG. 6.
Figure 8:
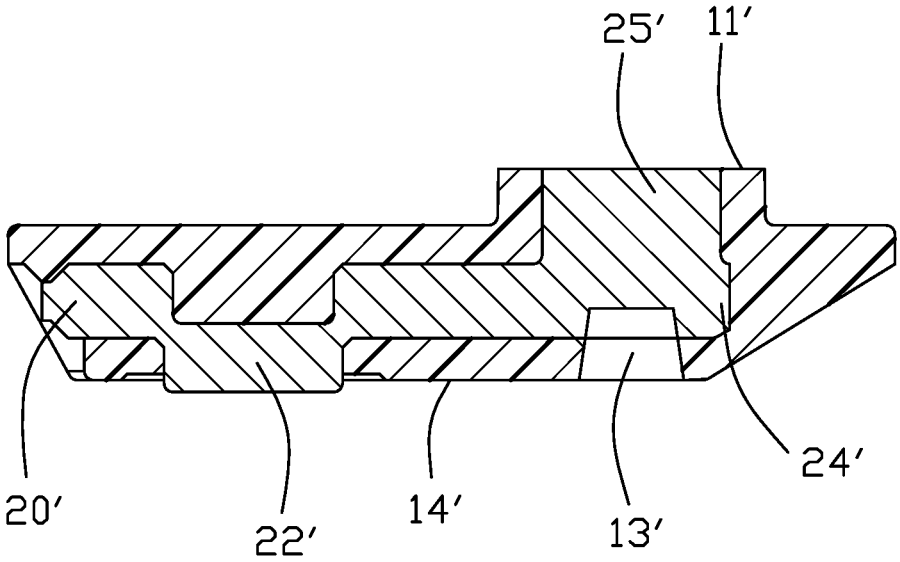
FIG. 8 is a cross-sectional view along line 8-8 shown in FIG. 6.
Figure 9:
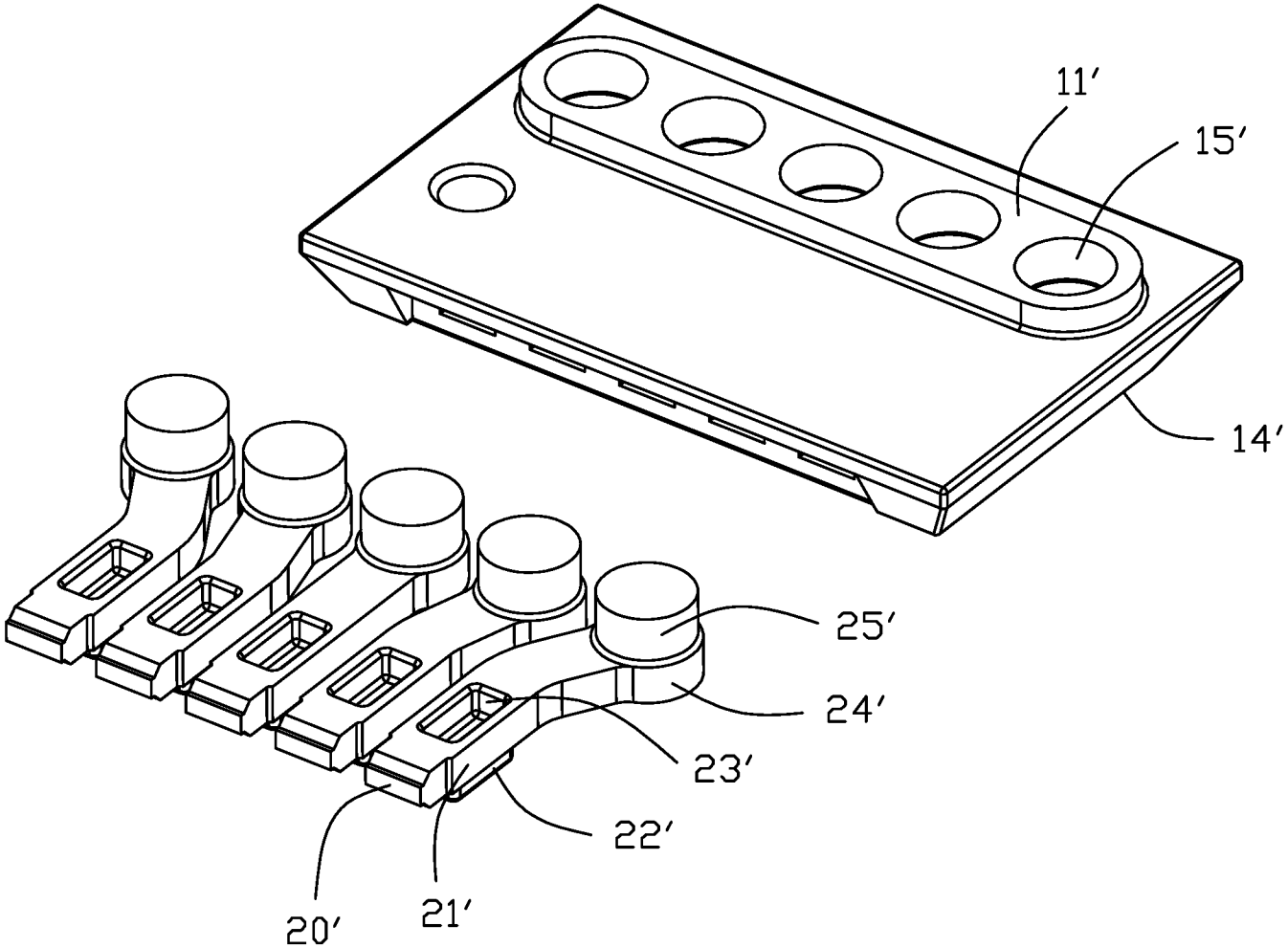
FIG. 9 is an exploded perspective view of the electrical connector in FIG. 6
Figure 9A:
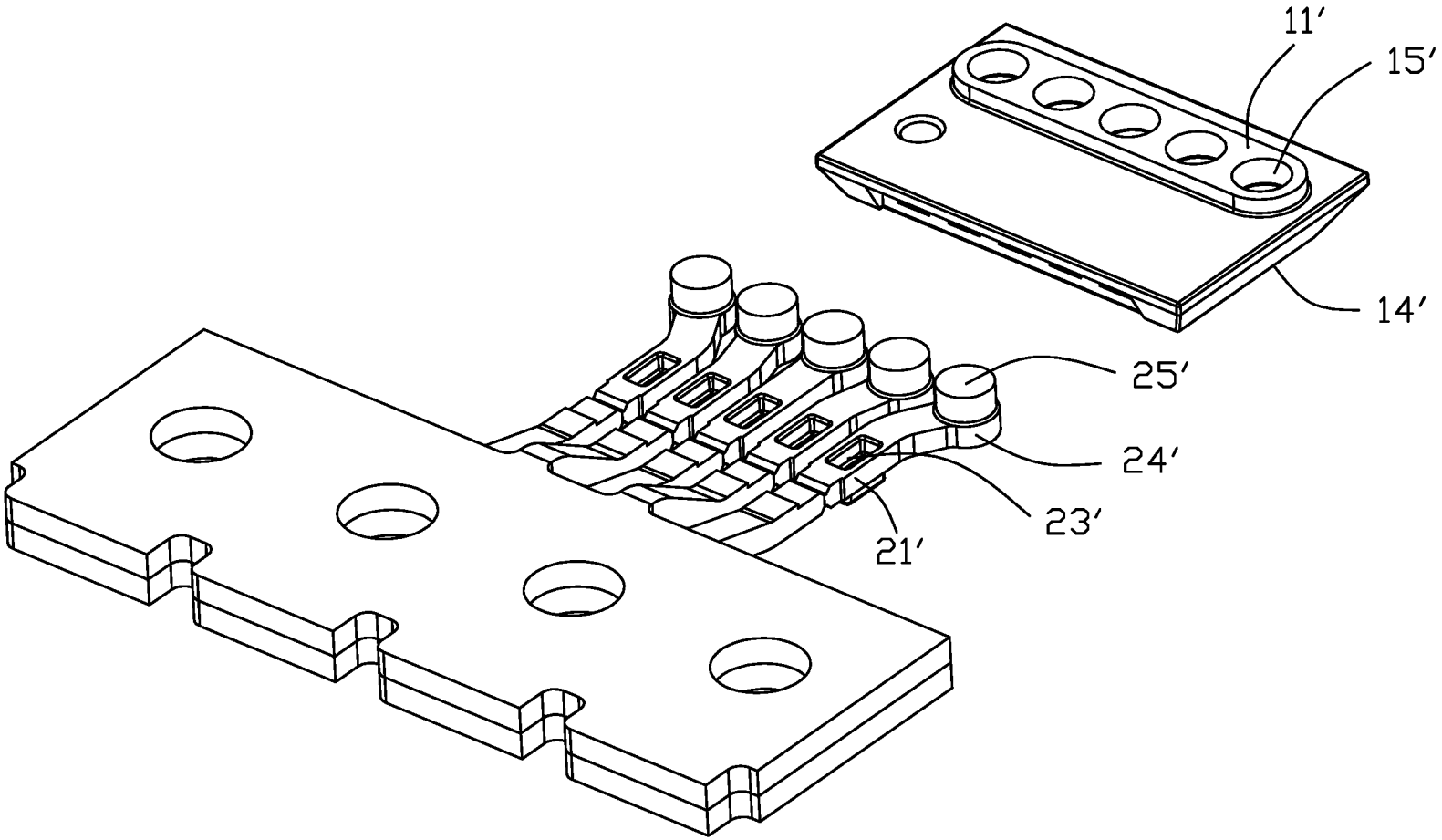
FIG. 9(A) is an exploded perspective view of the electrical connector in FIG. 6 with corresponding contact carriers unremoved therefrom and FIG. 10 is another exploded perspective view of the electrical connector in FIG. 9.
Figure 10:
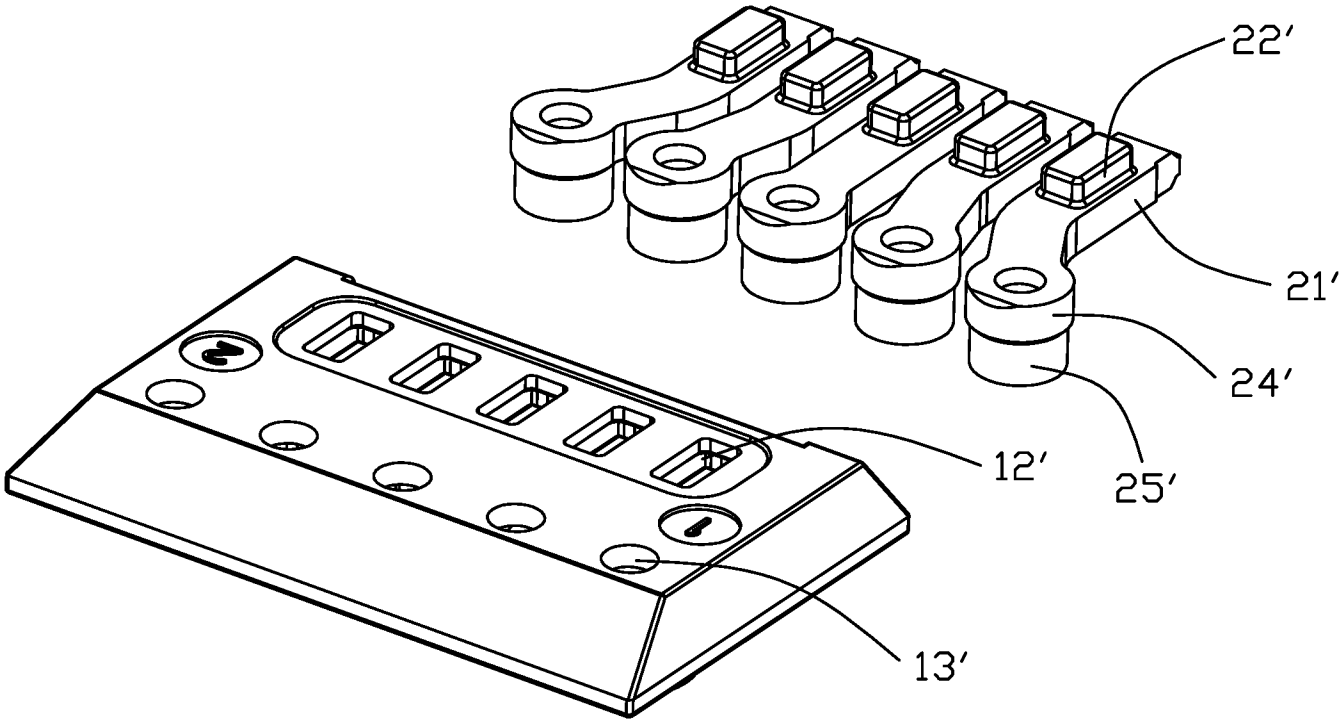

Referring to FIGS. 6 to 10, an electrical connector 10' in accordance with a second embodiment of the present invention includes an insulative housing 10' and five terminals 20' insert molded in the insulative housing 10'. The insulative housing 10' includes a first contact surface 14' engaging with a printed circuit board and a second contact 11' surface engaging with a mating connector. The insulative housing 10' includes five receiving slots 12' and five through holes 13' recessing upwardly from the first contact surface 14'. The insulative housing 10' includes five receiving holes 15' recessing downwardly from the second contact surface 11'. The five terminals 20' are arranged in a horizontal row. Each of the terminals 20' includes a first body 21' extending along a front-to-back direction and a second body 24' extending forwardly from the first body 21'. The first body 21' includes a first face and a second face opposite to the first face. The first body 21' includes a first projecting portion 22' formed by drawing downwardly from the first face. The first body 21' defines a first slot 23' recessing downwardly from the second face 11'. The first projecting portion 22' is received in the receiving slot 12' and extends downwardly beyond the first contact surface 14' of the insulative housing 10'. A second projecting portion 25' is formed by stamping/forging the second body 24' along a vertical direction. The second projecting portion 25' is received in the receiving hole 15'. The top surface of the second projecting portion 25' is aligned with the second contact surface 11' of the insulative housing 10'.

A method of the electrical connector 100' includes following steps: (1) provide a terminal strip including a first body 21' and a second body 24'; (2) a first projecting portion 22' is formed by a way of drawing from the first body 21', and a second projecting portion 25' is formed by stamping the second body 24' along a vertical direction; (3) a plurality of terminals 20' are formed by cutting the terminal strip/carrier; (4) a plurality of terminals 20' are insert molded in the insulative housing 10'. The terminals are formed by drawing and stamping/forging, and the first projecting portion and the second projecting are insert molded in the terminal, therefore the terminal has a larger intensity. It is also noted that in this embodiment even though the second projecting portion 25' of all five terminals 20' are located the same level, the two contact carriers are used for consideration of manufacturability thereof due to the relatively fine pitch of all five terminals 20'. Notably, in the second embodiment the second projecting portion 25' further forms a recess (not labeled) adjacent to the corresponding through hole 13' so as to allow the core pin of the mold to extend through the corresponding through hole 13 and further into the recess for supportably positioning the corresponding second projecting portion 24' not only in the vertical direction but also in horizontal directions during the insert-molding process.

However, the disclosure is illustrative only, changes may be made in detail, especially in matter of shape, size, and arrangement of sections within the principles of the invention.

What is claimed is:

1. An electrical connector comprising:

an insulative housing; and a plurality of terminals received in the insulative housing, each of the terminals having a first body extending along a front-to-back direction and a second body extending forwardly from the first body; wherein the first body has a first projecting portion formed by drawing along a vertical direction perpendicular to the front-to-back direction, and the second body has a second projecting portion formed by forging along the vertical direction, wherein the electrical connector further comprises a plurality of first terminals arranged in a first horizontal row and a plurality of second terminals arranged in a second horizontal row; wherein the second projecting portion of the second terminal is thicker than the second projecting portion of the first terminal.

2. The electrical connector as claimed in claim 1, wherein the first body has a first face and a second face opposite to the first face, the first projecting portion is formed in the first face, a first slot is formed in the second face.

3. The electrical connector as claimed in claim 1, wherein the terminals are arranged in a horizontal row.

4. The electrical connector as claimed in claim 1, wherein the terminals are insert molded in the insulative housing.

5. The electrical connector as claimed in claim 1, wherein the insulative housing has a first contact surface engaging with a printed circuit board and a second contact surface engaging with a mating connector, the first projecting portion extends beyond the first contact surface, and a top face of the second projecting portion is aligned with the second contact surface of the insulative housing.

6. The electrical connector as claimed in claim 5, wherein the insulative housing has a plurality of receiving holes recessing downwardly from the second contact surface, the second projecting portion is received in the receiving hole, the insulative housing has a plurality of receiving slots, and the first projecting portion is received in the receiving slot.

7. The electrical connector as claimed in claim 5, wherein the first contact surface and the second contact surface face two opposite directions.

8. A method of making an electrical connector comprising steps:

(1) provide a plurality of terminals each with a first body and a second body wherein the first bodies of said terminals are all linked with a common contact carrier opposite to the corresponding second bodies in a front-to-back direction;

(2) forming a first projection by drawing from the first body along a first vertical direction perpendicular to the front-to-back direction;

(3) forming a second projection by forging the second body along a second vertical direction perpendicular to the front-to-back direction and opposite to the first vertical direction;

(4) integrally forming an insulative housing with the terminals by an insert-molding process to commonly form said electrical connector; and (5) removing the contact carrier from the corresponding terminals.

9. The method as claimed in claim 8, wherein the first projection forms a slot filled by the insulative housing.

10. The method as claimed in claim 8, wherein the insulative housing forms a plurality of through holes to supportably position the corresponding second projections in the second vertical direction during the insert-molding process, respectively.

11. The method as claimed in claim 10, wherein the second projection forms a recess communicating with the corresponding through hole for supportably positioning the corresponding second projection horizontally.

12. The method as claimed in claim 8, wherein the terminals are divided into first and second groups alternately arranged with each other in a transverse direction perpendicular to both said front-to-back direction and the first and second vertical directions, each group has a corresponding contact carrier, and the contact carrier of the first group is stacked upon that of the second group.

13. The method as claimed in claim 12, wherein a depth of the second projection of the terminal in the first group is different from that in the second group even though a depth of the first projection of the terminal in the first group is same with that in the second group.

14. An electrical connector comprising:

an insulative housing defining oppositely facing-away first and second surfaces in a vertical direction;

a plurality of terminals embedded within the housing via an insert-molding process and divided into first and second groups alternately arranged with each other in a transverse direction perpendicular to said vertical direction, each of said terminals includes a first body and a second body linked with each other in a front-to-back direction perpendicular to both said transverse direction and said vertical direction, a first projecting portion formed on the first body and exposed upon the first surface, a second projecting portion formed on the second body and exposed upon the second surface; wherein the first projecting portion of each of the terminals forms a slot which the insulative housing occupies, and the housing forms a plurality of through holes extending in the vertical direction communicating with the corresponding second projecting portions in the vertical direction, respectively.

15. The electrical connector as claimed in claim 14, wherein each of said second projecting portions forms a recess communicating with the corresponding through hole in the vertical direction.

16. The electrical connector as claimed in claim 15, wherein the second projecting portions of the terminals in the first group are dimensioned different from those in the second group in the vertical direction while the first projecting portions of all the terminals are located at a same level in the vertical direction.

17. The electrical connector as claimed in claim 16, wherein the second body of the terminals in the first group is longer than that in the second group in the front-to-back direction.

18. The electrical connector as claimed in claim 17, wherein the second projecting portions of the terminals in the first group is dimensioned smaller than that in the second group in the vertical direction.

* * * * *